United States Patent [19]

Takano

[11] 4,259,557

[45] Mar. 31, 1981

[54] RECTANGULAR ELECTRIC CONTACT FOR SWITCH

[76] Inventor: Tetsuo Takano, 446 Tachihongo, Yatsuomachi, Nei-gun, Toyama-ken, Japan

[21] Appl. No.: 39,599

[22] Filed: May 16, 1979

[30] Foreign Application Priority Data

May 19, 1978 [JP] Japan ..... 53-58843

[51] Int. Cl.[3] ..... H01H 1/06; H01H 1/22

[52] U.S. Cl. ..... 200/275; 200/244

[58] Field of Search ..... 200/275, 239, 244, 246, 200/267, 278, 280, 275, 244; 275/244

[56] References Cited

U.S. PATENT DOCUMENTS

| | | | |
|---|---|---|---|
| 1,197,168 | 9/1916 | Ziegler | 200/275 |
| 2,721,246 | 10/1955 | Bourns | 200/275 X |
| 2,861,140 | 11/1958 | Woodall et al. | 200/244 X |
| 3,569,653 | 3/1971 | Cockshutt | 200/275 X |

*Primary Examiner*—Steven M. Pollard

*Attorney, Agent, or Firm*—Oblon, Fisher, Spivak, McClelland & Maier

[57] ABSTRACT

Rectangular electric contacts are produced by forming rectangular holes in base pieces, inserting into the rectangular holes contact pieces of a profile identical to the profile of the rectangular holes and pressing the portions of the contact pieces protruding out of the rectangular holes in the opposite directions. In consequence of the pressing, the contact pieces are laterally expanded to fill up the rectangular holes in the base pieces and the portions of the contact pieces protruding from the rectangular holes are crushed sideways to give rise to extended portions somewhat greater in size than the rectangular holes and similar in shape thereto. The extended portions serve as points of contact.

4 Claims, 21 Drawing Figures

RECTANGULAR ELECTRIC CONTACT FOR SWITCH

BACKGROUND OF THE INVENTION

This invention relates to a rectangular electric contact for use in a switch.

Although most switch contacts are circular, it is also quite common to employ angularly shaped contacts (particularly rectangularly shaped ones) in order to assure reliable contact even if some degree of misalignment should occur between contact pairs.

Circular contacts have heretofore been manufactured by two methods: One method involves fabricating rivet-shaped contact pieces out of a contact stock such as of silver, copper or alloys thereof, inserting the rivet-shaped contact pieces into holes made in or through base pieces such as of copper or brass and fastening the contact pieces firmly onto the base pieces as by hammering or pressing; and, the other method comprises welding circular contact pieces onto base pieces.

In the case of rectangular contacts, however, rivet-shaped rectangular contact pieces are difficult to mass produce because of the complex shape of the contact. Thus, it has been an established practice to form such rectangular contacts by welding rectangular contact pieces onto corresponding base pieces.

Contacts produced by resistance welding, however, have several problems. Since both the contact pieces and the base pieces are inherently made of substances of low electric resistance, the two pieces are welded by the projection welding technique. In welding by this method, since fusion between the pieces occurs only in the region of projection where the electric current is concentrated, the area of fusion between the two pieces is only about 5 to 10% of the total area of apparent contact. The area of such apparent contact between the two pieces, therefore, has substantially no electrical or thermal conductivity and the area of fast fusion has limited conductivity. Thus, these contacts do not fully satisfy their function. To make matters worse, these contacts do not readily permit thorough inspection of the welded portions. If a contact with imperfect fusion between the contact piece and the base piece should escape detection in the inspection, there is a fair possibility of the contact piece coming off the base piece while the contact is in service. Contacts made by resistance welding are thus unreliable. A further problem issues from the inevitable intervention of a projection between the contact piece and the base piece while the welding work is in process.

Consequently, it is difficult to secure accurate control of the position at which the contact piece is welded onto the base piece. It is also difficult to manufacture all the contact pieces in a uniform height. Thus, there is a possibility that the opposed contacts in some of the assembled switches will fail to come into effective contact or that the position at which the switching is effected will vary from one switch to another. Particularly in the case of micro-switches which are required to offer dimensional accuracy on the order of microns as to the contacts incorporated therein, the variation in quality in the individual switches being manufactured makes it impossible to obtain switches of accurate and reliable performance.

In spite of these unsolved problems, the aforementioned resistance welding technique continues to be used for the sole reason that there exists no other effective mass-production technique.

The inventor formerly developed a novel method for pressing a contact into position in the manufacture of micro-switches. This previously proposed method aims to accomplish mass production of contacts by feeding a metal strip as the stock for base pieces and a metal wire as the stock for contact pieces simultaneously into a continuous press and thereby attaching contact pieces to the corresponding base pieces by pressing and, at the same time, forming the individual base pieces as combined firmly with the contact pieces in a required shape to give rise to micro-switches (U.S. Pat. No. 3,967,369).

SUMMARY OF THE INVENTION

An object of this invention is to provide rectangular contacts for use in switches, which function excellently as switch contacts and enjoy rugged construction and reliable performance.

Another object of this invention is to provide rectangular contacts for use in switches, which can be mass produced in uniform quality.

A further object of the present invention is to provide rectangular contacts for use in switches which can be produced economically even from an expensive contact stock by virtue of the fullest possible utilization of the stock.

To accomplish the objects described above according to the present invention, there are provided rectangular contacts for use in switches, each of which comprises a base piece having an rectangular hole formed therein and a contact piece filling up the aforementioned rectangular hole and extending out of the upper and lower edges thereof, the upper and lower extended portion of the contact piece being in a rectangular shape similar to and greater than the rectangular hole.

Specifically, the rectangular contact of the present invention is produced by inserting into the rectangular hole of the base piece a contact piece having the same profile as that of the rectangular hole and a greater thickness than the rectangular hole and pressing the contact piece in opposite directions toward the center of the contact piece. In consequence of the pressure thus applied, the contact piece comes into perfectly intimate contact with the four inner walls of the rectangular hole and fills the rectangular hole with great tightness and the protruding portions of the contact piece are crushed down to completely cover the rectangular hole, resulting in a contact.

Since the manufacture of this rectangular contact is accomplished by inserting the contact piece into the rectangular hole of the base piece and pressing the contact piece in opposite directions, the contact piece and the base piece in the produced contact remain in intimate union, and offer good electrical and thermal conductance therebetween. Further, the size of the protruding portions of the contact piece which are destined to function as the points of contact in the produced contact can be freely adjusted by controlling the conditions of the pressing work and selecting the size of the contact piece. Thus, the rectangular contacts of the present invention can easily be mass produced in rigidly controlled quality and uniform size. Owing to the principle of manufacture described above, the rectangular contacts of the present invention can be produced economically by using as the stock for contact pieces a metal wire with a width equaling one of the sides of the area of the rectangular hole and cutting this metal wire at intervals of a length equalling the other side of the aforementioned area, so that the contact pieces thus cut out of the metal wire will be received directly, as they are, in the holes of the base pieces and the metal wire is utilized without any loss. Alternatively, the rectangular contacts of the present invention can be produced by using as the stock for contact pieces a composite metal wire which has a relatively thin layer of silver, silver alloy or gold deposited as by the explosion cladding technique on each opposite outer surface of a thick intermediate layer of an inexpensive metal such as copper or copper alloy. Although the contacts produced from this composite metal wire function substantially similarly to those contacts which are made wholly of such noble metals, they are far less expensive.

The other objects and characteristic features of the present invention will become apparent from a detailed description of the invention to be given hereinafter with reference to the accompanying drawing.

DESCRIPTION OF PREFERRED EMBODIMENT

Figure 1:
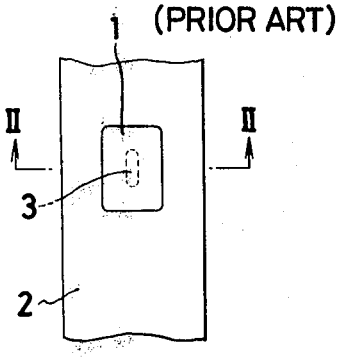
Fig 1 (PRIOR ART)
FIG. 1 is a plan view of a typical rectangular contact obtained by the conventional method resorting to welding.
Figure 2:
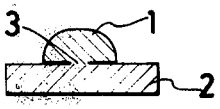
Fig 2 (PRIOR ART)
FIG. 2 is a sectional view taken along the line II—II of the rectangular contact of FIG. 1.

FIG. 1 and FIG. 2 illustrate a rectangular contact manufactured by the conventional method utilizing the resistance welding technique. Although the contact piece 1 and the base piece 2 appear to be in close joined relation, they are actually joined only in the fused portion 3. Thus, the conduction of electricity and heat substantially occurs only through the fused portion 3. For this reason, the heat which is generated at the point of contact in consequence of the ON-OFF operation of the switch to make and break the continuity of the path of electric current is inevitably accumulated in the contact piece and is not easily dispersed. Further, the mechanical strength of the fused portion between the contact piece and the base piece varies greatly from switch to switch because of various uncontrollable factors such as the area of the fused portion, the degree of fusion of two different metals, the phenomenon of notching, and the occurrence of residual stress due to welding. These rectangular contacts lack reliability because the contact pieces may come off their corresponding base pieces unexpectedly while the contacts are in service.

Figure 3:
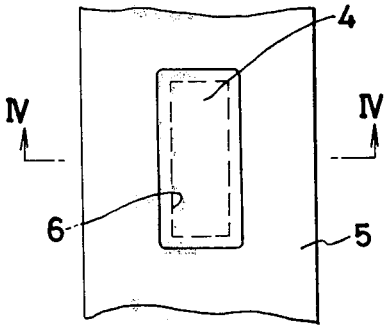
FIG. 3 is a plan view of a rectangular contact according to the present invention.
Figure 4:
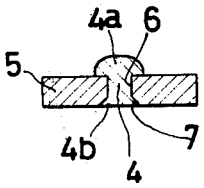
FIGS. 4–10 are sectional views of seven embodiments of the rectangular contacts of the present invention, as taken along the line IV—IV of the plan view of FIG. 3.

Now, the rectangular contacts of the present invention for use in switches will be described with reference to the diagram of FIG. 3 and the subsequent diagrams.

FIGS. 4–10 are sectional views of embodiments of rectangular contacts of the present invention. Despite the wide variance in sectional configuration, all these rectangular contacts of the present invention are substantially identical in plan view as illustrated in FIG. 3.

All these embodiments share a common construction which comprises a base piece 5 incorporating a rectangular hole 6 and a contact piece 4 filling up the aforementioned rectangular hole 6 and further protruding vertically and extending horizontally from the upper and lower edges of the hole. The upper and lower extended portions 4*a*, 4*b* of the contact piece 4 are produced by cutting from the stock (of any of the constructions shown in FIGS. 11–17) those contact pieces of a cross-sectional area equalling the area of the rectangular hole 6, inserting the cut contact pieces in the rectangular holes of the corresponding base pieces in such a way as to protrude in the opposite vertical directions from the base pieces, and pressing the contact pieces in the opposed vertical directions toward their centers so that the protruding portions of the contact pieces are crushed and extended from the edges of the rectangular holes. The upper and lower extended portions, therefore, are somewhat greater than the rectangular holes 6 and are substantially similar thereto. In actuality, while the rectangular holes and the portions of the contact pieces enclosed with the holes are perfectly rectangular, the upper and lower extended portions formed in consequence of the pressing have more or less rounded corners. Lack of sharp corners in these extended portions, however, has no effect whatever upon the ability of the contacts to fulfill their function.

Now, an embodiment of the process for the manufacture of rectangular contacts according to the present invention will be described with reference to FIGS. 18–21.

Figure 18:
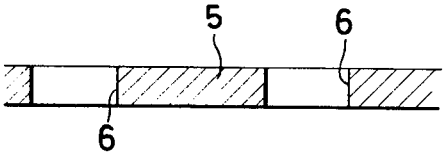
FIGS. 18–21 are explanatory diagrams illustrating serially one embodiment of the process for the manufacture of rectangular contacts according to the present invention.
Figure 19:
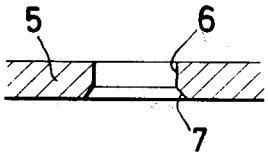
Figure 20:
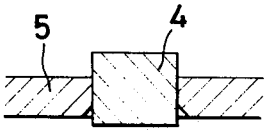
Figure 21:
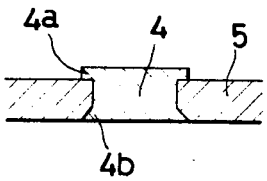

By a known continuous process, rectangular holes 6 are formed in the stock 5 for base pieces at fixed intervals as illustrated in FIG. 18. The lower edges of the rectangular holes 6 thus formed are either crushed or cut to give rise to chamfers 7 as illustrated in FIG. 19. Above the rectangular holes which have undergone the chamfering treatment described above, there is disposed the stock 8 for contact pieces having a construction as shown in FIGS. 11–17. This stock has a width equalling one of the sides of the rectangular holes. This stock is cut at fixed intervals equaling the other side of the rectangular holes to give birth to contact pieces, which are successively inserted into the rectangular holes 6 of the base pieces 5 disposed directly thereunder (FIG. 20). The means used for cutting the contact pieces from the stock and inserting them in the rectangular holes are obvious from the prior art and, therefore, are omitted from the illustration. The contact pieces thus inserted in the rectangular holes are slightly pressed in the opposite vertical directions as a precautionary measure where there is a possibility of the inserted contact pieces falling off the base pieces. Then, the base pieces which have the contact pieces set in position therein are subjected to regular pressing in the opposite vertical directions, with the result that the portions of the contact pieces enclosed in the rectangular holes tightly fill up the rectangular holes and the portions thereof protruding from the opposite edges of the rectangular holes are crushed to form the extended portions 4*a*, 4*b* as illustrated in FIG. 21. The shape assumed by these extended portions is determined by the size of the contact pieces, the force used in the pressing and the position in which the contact pieces are inserted in the rectangular holes. When the contact pieces are fastened in the rectangular holes in the base pieces as described above, the two pieces assume and thereafter remain in intimately adjoined state.

After the upper and lower extended portions of the contact pieces are formed in a prescribed shape to produce points of contact on the base pieces, the metal strip still containing therein the individual base pieces in a continuous row is cut at fixed intervals to yield to separate and complete contacts.

As the device for producing the aforementioned rectangular holes, the device for chamfering the lower edges of the rectangular holes, the device for cutting contact pieces from the stock, the device for inserting the cut contact pieces in the rectangular holes, the device for pressing the contact pieces in the base pieces and the device for cutting the base pieces from the stock there can be used those already known in the art. Automated manufacture of contacts provided with contact pieces of the present invention is accomplished by a system having these devices arranged in the sequence of the works involved.

The shape of the contacts to be formed on the base pieces and the shape of the base pieces are determined by the particular kind of switches in which the finished contacts are to be incorporated. In the case of the contact illustrated in FIG. 4, the lower extended portion 4*b* of the contact piece is completely enclosed within the chamfered lower edges of the rectangular hole 6 so that the surface thereof is flush with the lower surface of the base piece, while the upper extended portion 4*a* is formed in the shape of a half cylinder. The shape of the upper extended portion 4*a* may be freely decided by suitably selecting the shape of the press used.

Figure 5:
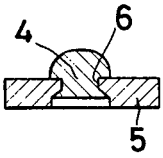

FIG. 5 represents an embodiment of the contact obtained by forming the rectangular hole in the upper half of the total thickness of the base piece, inserting the contact piece in the rectangular hole, pressing the contact piece and thereby crushing the portion of the contact piece protruding from the rectangular hole. The contacts in this embodiment are characterized by permitting the same degree of saving in the amount of the stock for contact pieces as when the thickness of the stock for base pieces is small.

Figure 6:
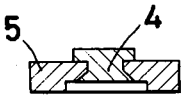
Figure 7:
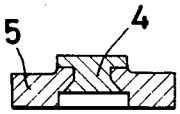
Figure 8:
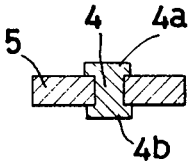

Illustrated in FIG. 6 is an embodiment which is substantially similar to that of FIG. 5 except for the fact that the upper extended portion of the contact piece has its upper surface flattened. The shape of this flattened upper extended portion of the contact piece can freely be decided by suitably selecting the shape of the press used. FIG. 7 illustrates an embodiment of the contact which is characterized by giving a raised portion in advance to the position of the base piece destined to contain therein a rectangular hole for the purpose of increasing the vertical distance between the upper surface of the contact piece and the base piece without having to increase the consumed amount of the stock for contact pieces. Illustrated by FIG. 8 is an embodiment characterized by having extended portions formed one each on the upper and lower surfaces of the base piece. By allowing the upper and lower extended points of this contact to be opposed to two separate contacts, there can be produced two switches.

The longitudinal and lateral sizes and the thickness of these extended portions and the shape of their surfaces of contact are automatically determined by the shape of the die of the press, the pressure applied with the press and the size of the contact pieces. Thus, the extended portions of the contact pieces can be formed in a desired shape by suitably selecting these factors.

Figure 9:
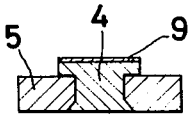
Figure 10:
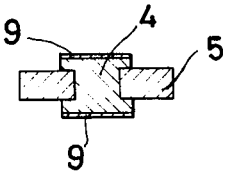
Figure 11:
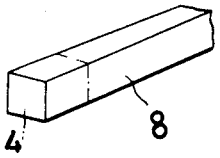
FIGS. 11–17 are perspective views of seven embodiments of the stocks for rectangular contacts according to the present invention.
Figure 12:
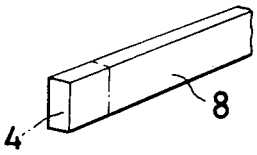
Figure 13:
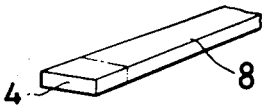
Figure 14:
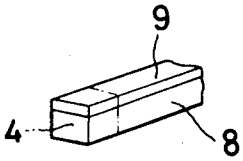
Figure 15:
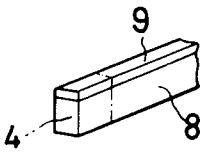
Figure 16:
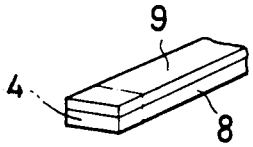
Figure 17:
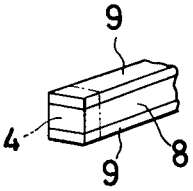

FIG. 9 represents an embodiment characterized by using, as the stock for contact pieces, a composite metal strip which has a layer 9 of silver or silver alloy explosion cladded as the surface layer for forming the extended portions onto a substrate 8 made of copper or copper alloy. FIGS. 14–16 illustrate three embodiments of such explosion cladded composite metal strips. FIG. 10 illustrates an embodiment of the contacts formed one each on the opposite surfaces of the base piece 5, as produced by using a composite metal strip which has silver or silver alloy layers 9 explosion cladded one each onto the opposite surfaces of a metal substrate. By using this cladded composite metal strip, contacts capable of fulfilling the same function as contacts using contact pieces formed wholly of silver can be produced less expensively. The embodiments described above involve use of composite metal strips which have layers of silver or silver alloy cladded on a metal substrate. When necessary, layers of gold may additionally be deposited on the aforementioned composite metal strips. The cladding of such noble metals onto substrates of base metals can be accomplished by a cladding method known to the art.

As is evident from the description given above, the present invention produces rectangular contacts by making rectangular holes in a metal strip as the stock for base pieces, inserting into the rectangular holes those contact pieces of a matching profile and pressing the pieces in the opposed directions and thereby bringing the base pieces and the contact pieces into intimate, perfect union and, at the same time, crushing the portions of the contact pieces protruding from the rectangular holes to produce points of contact somewhat larger than the rectangular holes. The shape of the contacts can easily be determined by such factors as the size of the contact pieces, the operation of the press used and the shape of the mold adopted. Thus, contacts of a desired shape can be formed with high accuracy on the base pieces and these contacts can readily be mass produced. The contacts thus produced can be advantageously used such as in micro-switches which are required to have dimensional accuracy on the order of microns.

As described above, the contacts of the present invention for use in switches are obtained not by welding but by pressing and, therefore, are free from the various shortcomings suffered inherently by the conventional contacts produced by welding. The present invention, therefore, provides contacts which excel in electric and thermal conductivity and enjoy high strength and reliability. Since the operation of manufacture involved simply comprises the steps of forming rectangular holes in the metal strip as the stock for base pieces, cutting contact pieces from the metal wire as the stock for contact pieces, inserting the contact pieces in the rectangular holes in the metal strip, pressing the contact pieces and cutting the metal strip now containing the contact pieces in the rectangular holes so as to separate the finished contacts, the productivity of the rectangular contacts of this invention is much higher than that of rectangular contacts manufactured by welding. Specifically, the rectangular contacts of the present invention can be produced at a high rate of about 500 pieces per minute. The equipment used for the manufacture is inexpensive and easy of maintenance because of the exclusion of a welding device. Further, the stock for contact pieces can be fully utilized effectively by preparing this stock with a width equaling one of the sides of the rectangular holes in the stock for base pieces and cutting the stock for contact pieces at fixed intervals equaling the other side of the aforementioned rectangular holes. Contacts of better performance can be manufactured without any appreciable addition to the expense by having a layer of a highly electroconductive noble metal such as silver, silver alloy or gold deposited as by explosion cladding only on the surface of the metal wire which is destined to act as a contact surface.

What is claimed as new and desired to be secured by Letters Patent of the United States is:

1. A rectangular electric contact for use in a switch, which comprises a base piece containing therein a rectangular through hole and a contact piece filling up said rectangular hole and having opposite end portions extending out of the upper and lower edges of said hole, said contact piece being cut from an elongate strip of material comprising at least two layers of dissimilar materials, and said contact piece having a uniform rectangular cross sectional shape from end to end and comprising at least two layers of dissimilar materials, said contact piece having a width equalling one of the sides of the rectangular holes and being cut from the elongate strip of material and substantially simultaneous therewith being insertion in the hole so that the uppermost layer thereof protrudes from the upper surface of said base piece and then substantially simultaneous with the inserted step being pressed in an axial direction of the hole to laterally expand the contact piece for tight fitting engagement in the hole, and the extended end portions having a rectangular shape which is somewhat greater than said rectangular hole and is similar in shape thereto.

2. The rectangular contact according to claim 1, wherein said extended portions are provided with a layer of a metal selected from the group consisting of silver and silver alloy.

3. A method for the manufacture of a rectangular electric contact which comprises the steps of: forming rectangular through holes at fixed intervals in a stock for base pieces; cutting layered contact pieces with a rectangular configuration of a profile identical to the profile of the rectangular holes out of an elongate, rectangularly shaped stock for contact pieces, said stock having a width equalling one of the sides of the rectangular holes and comprising at least two layers of dissimilar materials; inserting, substantially simultaneously with the cutting step, the contact pieces in the rectangular holes; pressing, substantially simultaneously with the inserting step, the contact pieces set in position in the rectangular holes in opposite directions and crushing the portions of the contact piece protruding from the opposite sides of the rectangular hole to give rise to contacts which are somewhat larger in size than the rectangular holes and similar in shape thereto.

4. The method according to claim 3, wherein the stock for contact pieces is prepared to have a width equaling one of the sides of the rectangular holes and is cut at fixed intervals of a length equaling the other side of the rectangular holes.

* * * * *